US006887211B1

(12) United States Patent
Sevier et al.

(10) Patent No.: US 6,887,211 B1
(45) Date of Patent: May 3, 2005

(54) INSTRUMENT FOR DIAGNOSING AND TREATING SOFT TISSUE ABNORMALITIES THOUGH AUGMENTED SOFT TISSUE MOBILIZATION

(75) Inventors: Thomas L. Sevier, Muncie, IN (US); Robert H. Helfst, Jr., Muncie, IN (US); Sue A. Stover, Upland, IN (US); Eric W. Tisdale, Indianapolis, IN (US)

(73) Assignee: Performance Dynamics, Inc., Muncie, IN (US)

( * ) Notice: Subject to any disclaimer, the term of this patent is extended or adjusted under 35 U.S.C. 154(b) by 0 days.

(21) Appl. No.: 10/677,281

(22) Filed: Sep. 26, 2003

Related U.S. Application Data

(62) Division of application No. 09/898,623, filed on Jul. 3, 2001, now Pat. No. 6,641,547, which is a division of application No. 08/695,873, filed on Aug. 12, 1996, now Pat. No. 6,254,555.

(51) Int. Cl.[7] ..... A61H 7/00
(52) U.S. Cl. ..... 601/135; 601/137; D24/214
(58) Field of Search ..... 601/134, 135, 601/136, 137, 138; 606/204; D24/200, 214, 215

(56) References Cited

U.S. PATENT DOCUMENTS

| | | | |
|---|---|---|---|
| D30,230 | S | 2/1899 | Barnet |
| 1,373,970 | A | 4/1921 | Peasley |
| 1,612,343 | A | 12/1926 | Amussen |
| 1,769,872 | A | 7/1930 | Weeks |
| 1,987,390 | A | 1/1935 | Davis |

(Continued)

FOREIGN PATENT DOCUMENTS

| | | |
|---|---|---|
| DE | 10702 | 6/1895 |
| DE | 848544 | 9/1952 |
| DE | 909768 | 4/1954 |
| DE | 2303544 | 8/1974 |
| FR | 002637496 A1 | 4/1990 |

OTHER PUBLICATIONS

Awareness & Health Unlimited, "1995–1996 15$^{th}$ Year Anniversary Wholesale Catalog," pp. 189, 192–193, 196, 234–235.

The Stick™ Muscle Device Instructional Sheet (date unknown).

(Continued)

*Primary Examiner*—Justine R. Yu
*Assistant Examiner*—Quang D. Thanh
(74) *Attorney, Agent, or Firm*—Woodard, Emhardt, Moriarty, McNett & Henry LLP

(57) ABSTRACT

Presented are novel instruments intended for use in the diagnosis and treatment of fibrotic soft tissue through soft tissue mobilization therapies performed on, particularly, a human patient. Three such instruments are provided by the invention including a variety of curvilinear and linear tissue-engaging edges and converging surfaces accommodating their use on the irregular contours of numerous soft tissue areas of the human body.

12 Claims, 12 Drawing Sheets

U.S. PATENT DOCUMENTS

| | | | |
|---|---|---|---|
| 2,044,112 | A | 6/1936 | Widmann |
| 2,219,436 | A | 10/1940 | Anderson |
| D155,773 | S | 11/1949 | Becker |
| 2,752,623 | A | 7/1956 | Tupper |
| 2,806,470 | A | 9/1957 | Ferrier |
| 3,107,665 | A | 10/1963 | Nordgren |
| D211,549 | S | 6/1968 | Christopher |
| 3,389,418 | A | 6/1968 | Sencabaugh |
| 3,557,776 | A | 1/1971 | Boots |
| 3,888,241 | A | 6/1975 | Fischer |
| D237,313 | S | 10/1975 | Harris |
| D262,908 | S | 2/1982 | Pesco |
| D263,077 | S | 2/1982 | Stanton |
| D264,754 | S | 6/1982 | Vitra |
| 4,378,007 | A | 3/1983 | Kachadourian |
| D272,090 | S | 1/1984 | Hosid |
| 4,461,285 | A | 7/1984 | Courtin |
| 4,483,328 | A | 11/1984 | Wolocko |
| 4,590,926 | A | 5/1986 | Courtin |
| D285,116 | S | 8/1986 | Hoff |
| D288,847 | S | 3/1987 | Kaeser |
| 4,648,387 | A | 3/1987 | Simmons |
| 4,705,030 | A | 11/1987 | Tepperberg |
| 4,732,142 | A | 3/1988 | Hurlburt et al. |
| D304,495 | S | 11/1989 | Tyo et al. |
| 4,993,408 | A | 2/1991 | Schweisfurth |
| D317,204 | S | 5/1991 | Henneseey |
| D323,035 | S | 1/1992 | Yang |
| 5,080,111 | A | 1/1992 | Pallin |
| 5,085,207 | A | 2/1992 | Fiore |
| 5,103,809 | A | 4/1992 | DeLuca et al. |
| D328,328 | S | 7/1992 | Juarez |
| D338,964 | S | 8/1993 | Tarjoto |
| 5,231,977 | A | 8/1993 | Graston |
| D342,999 | S | 1/1994 | Gonsalves, Jr. |
| D345,801 | S | 4/1994 | Bosch |
| 5,307,816 | A | 5/1994 | Hashimoto et al. |
| 5,366,437 | A | 11/1994 | Graston |
| D357,322 | S | 4/1995 | Matthews |
| 5,441,478 | A | 8/1995 | Graston |
| D362,307 | S | 9/1995 | Cirone |
| D373,197 | S | 8/1996 | Schepper |
| 5,624,385 | A | 4/1997 | Hwang |
| 6,077,239 | A | 6/2000 | Lin |

OTHER PUBLICATIONS

B. Steward, R. Woodman, & D. Hurlburt, "Fabricating a Splint for Deep Friction Massage," *Journal of Orthopaedic and Sports Physical Therapy;* vol. 21, No. 3 Mar. 1995, pp. 172–175.

G. Chamberlain, "Cyriax's Friction Massage: A Review," *Journal of Orthopaedic and Sports Physical Therapy*; vol. 4, No. 1, Summer 1982, pp. 16–22.

S. Lachmann, *Soft Tissue Injuries in Sport*, Blackwell Scientific Publications; 1988, pp. 12–16 & 19–21.

J. Cyriax, *Textbook of Orthopaedic Medicine;* vol. One, 1982, pp. 14–21.

J. Cyriax, *Textbook of Orthopaedic Medicine;* vol. Two, 10$^{th}$ Edition, 1980, pp. 1–37.

M. Cunningham, "How to Activate Your Healing Response An Alternative To Medication and Surgery," *Acupressure Ancient Wisdom for Modern Day Healing;* 1994, pp. 41–42.

J. Travell, M.D., and D. Simons, M.D., *Myofascial Pain and Dysfunction The Trigger Point Manual The Upper Extremities;* vol. 1, 1983, pp. 19–21, 59–61, 87, 88 & 99–102.

Advertisement for "Massage Stones," *Massage*, Issue No. 56, Jul./Aug. 1995, p. 77.

Advertisement for The Knobble™, *Massage;* Issue No. 56, Jul./Aug. 1995, p. 158.

J. Barnes, P.T., "The Myofascial Release Approach, Part II The Mind/Body Connection," *Massage;* Issue No. 50, Jul./Aug. 1994, pp. 58 & 60–64.

Z. Kurashova Wine, "Massage for Sports Injuries," *Massage;* Issue No. 42, Mar./Apr. 1993, pp. 26–27.

S. Taws, "Alleviating Low Back Pain Through Soft Tissue Release," Massage; Issue No. 52, Nov./Dec. 1994, pp. 30–32.

K. Jeffery, "Seashells as Massage Tools," *Massage Therapy Journal;* Spring 1993, vol. 32, No. 2, pp. 72 & 73.

J. Horrigan, "Soft Tissue Center Therapy Facility of Tomorrow," *Ironman;* Jun. 1990, pp. 115, 116, 118 & 119.

S. Levin, "The Maverick of Sports Medicine," *Health;* Jan. 1991, pp. 30–32.

W. Prentice, Ph.D, *Therapeutic Modalities in Sports Medicine;* 1986, pp. 217–242.

B. Brudden, *Pain Erasure The Bonnie Prudden Way;* 1980, pp. 3–5, 15–17, 22, 99–101, 124 & 266–268.

W. Hammer, DC, *Functional Soft Tissue Examination and Treatment by Manual Methods The Extremities;* 1991, pp. 235–249.

Z. Kurashova Wine, "Russian Massage," *Massage;* Issue No. 33, Sep./Oct. 1991, pp. 40–43.

R. Nimmo, *The Technique;* 1966, pp. 50–55.

R. Woodman and L. Pare, "Evaluation and Treatment of Soft Tissue Lesions of the Ankle and Forefoot Using the Cyriax Approach," *Physical Therapy;* vol. 62, No. 8, Aug. 1982, pp. 1144–1147.

INSTRUMENT FOR DIAGNOSING AND TREATING SOFT TISSUE ABNORMALITIES THOUGH AUGMENTED SOFT TISSUE MOBILIZATION

This application is a divisional of Application No. 09/898,623, filed Jul. 3, 2001, now U.S. Pat. No. 6,641,547 which is a divisional of Application No. 08/695,873, filed Aug. 12, 1996, now U.S. Pat. No. 6,254,555, which are both incorporated herein by reference.

FIELD OF INVENTION

This invention relates to the evaluation and treatment of fibrotic soft tissue and, more particularly, to specially designed instruments for use in the diagnosis of fibrotic soft tissue and performing soft tissue mobilization therapies on a living subject.

BACKGROUND OF THE FIELD

Soft tissue massage, including deep friction or cross fiber massage, has been known and practiced manually, that is, by hand, for some time. Friction massage is different from the superficial massage given in a longitudinal direction parallel to the vessels. Early pioneers of friction massage working in the 1930's and '40s include David Mennell and James Cyriax. Mennell advocated the use of specific massage movements called "fraction" movements for conditions of inflammation and pathological deposits, as well as for recent ligament and muscle injuries. Cyriax later utilized a technique which he coined "deep friction massage" to reach the musculoskeletal structure of ligament, tendon and muscle and provide therapeutic movement over a small area.

The purpose of deep massage or the mobilization of soft tissue is to maintain the mobility within soft tissue structures of ligament, tendon, and muscle, and to break down and/or prevent fibrous adhesions, commonly known as scar tissue, from forming. Soft tissue mobilization, when performed properly, is performed deep into the soft tissue and, in cross fiber massage, is applied transversely, that is, not in a longitudinal direction but in a direction across the tissue fibers, to the specific fibrotic soft tissue involved.

The biological healing of soft tissue injury is similar in muscle, tendon, and ligament. When soft tissue is stressed beyond its biomechanical yield strength, microtearing of the soft tissue under stress typically occurs. The human body's normal response to the microtearing of collagen is inflammation. Scar tissue typically lays down in a three-dimensionally random fashion. This randomness can begin to affect the function (contractility and extensibility) of the surrounding tissues, which have a more uniform structure. Any loss of function may result in a reaggravation of the soft tissue during normal use and a vicious cycle of microtearing-inflammation-scarring.

The scientific reasons why soft tissue mobilization is successful are not fully understood. Yet, because this modality involves pressure and movement directed across or against the scar tissue, most theories are based on the effect of motion of healing tissue. It is well accepted today that early motion of injured tissue results in repair with reduced scar tissue formation or more improved alignment of the fibrosis and the soft tissue structure. In the early stages of healing, scar tissue is not as strong as in later stages, and it is thought that the remodeling phase of the inflammatory response depends on mechanical stimuli. Cyriax stated that transverse motion across the involved tissue and the resultant traumatic hyperemia were the chief healing factors.

Cyriax further stated that moving across the fibers at a right angle would not injure the normal healing tissue but would prevent the formation of or cause the break down of abnormal scar tissue. Transverse friction moved the involved tissue, Cyriax held, while longitudinal friction affected the transportation of blood and lymph through the blood vessels.

In the acute stage of an early lesion within soft tissue, collagen (scar tissue) is immature. During the first 4 or so days, fibroblasts lay down a gel-like substance, but it takes up to 2 weeks for mature cross-links of the collagen to form. In the early stage of an acute lesion, it is reasonable to use only a light fraction pressure. Light friction is primarily used to aid in the promotion of normal orientation of collagen, to maintain the mobility of the soft tissue, and to thereby prevent future scar tissue adhesions from forming. In the chronic stages, a deeper, stronger pressure is necessary.

To achieve mobilization of soft tissue, after the involved fibrotic soft tissue (muscle, tendon, or ligament) is located, typically through a combination of the practitioner's review of the patient's history and functional and physical diagnostic testing of the suspected fibrotic soft tissue areas, a practitioner can use a reinforced finger, i.e., middle finger over forefinger, that is just large enough to apply deep pressure across the injured fibrotic soft tissue. At times, because of the increased amount of pressure that must be applied or due to the density of the tissue being treated, it is advisable for the practitioner to employ a separate hand instrument. Such an instrument is also beneficial in preventing injury to the practitioner due to the prolonged period of time in which the increased pressure must be applied to the soft tissue areas of the patient.

Various tools are known for use in performing superficial massage which is given in a longitudinal direction parallel to the blood vessels to enhance blood circulation and the return of fluids to those areas of living subjects, particularly humans. For example, Courtin, U.S. Pat. No. 4,590,926, discloses a hand-held massager intended to provide effective massaging of various body parts.

Weeks, U.S. Pat. No. 1,769,872, describes a massage implement having a top surface, curved side surfaces, and a bottom surface. The curved sides and bottom are adapted to be held in the palm of the hand with the fingers arranged near a sharpened end, while the blunt end of the device is received in the palm of the hand. The top surface of the Weeks device is provided with a series of undulations intended to give the body parts massaged the same effect as though a manual massage is being performed. This device is primarily intended to be used about the face and neck.

Various other tools which have been disclosed in the prior art for use in massage include Des. 262,908; Des. 263,077; Des. 264,754; Des. 272,090; Des. 285,116; Des. 288,847; Des. 317,204; and Des. 323,035.

More recently, Warren Hammer, D. C., taught, inter alia, the use of a small rubber-tipped hand tool (commonly referred to as a "T-bar") to perform cross-friction massage of, particularly, plantar, fascitis, plica, and patellar ligament lesions. See, *Functional Soft Tissue Examination and Treatment by Manual Methods: The Extremities* (Aspen Publications, Inc., Copyright 1991).

There continues to remain a need, however, for instruments of improved ergonomic design to better assist a practitioner not only in the treatment of fibrotic soft tissue by way of soft tissue mobilization therapies, but in its diagnosis as well.

SUMMARY OF THE INVENTION

This invention presents novel instruments intended for use in the diagnosis and treatment of fibrotic soft tissue through soft tissue mobilization therapies performed on, particularly, human patients.

A first embodiment of such an instrument provided by this invention includes a hand-held rigid unitary body comprising an upper handle portion, a lower massaging portion formed by a pair of sides converging from the upper handle portion and terminating along a tissue-engaging lower edge, and a peripheral edge extending about the circumference of the instrument. The circumferential peripheral edge of the instrument is defined by a curvilinear edge including a tissue-engaging concave leading edge and a convex rear edge disposed opposite from the leading edge. The sides of the instrument taper in one direction to form an inclined chisel-like surface leading to the concave leading edge. The instrument's sides further taper toward one another from a central portion of the instrument longitudinally in both directions toward each end of the instrument to define, from a top plan view, an equiconvex shape. The body of the instrument has sufficient length to define a firmly graspable instrument that is longer than it is wide.

The leading edge of the instrument includes a concavely curved peripheral edge extending substantially from the upper edge of the instrument to the lower edge thereof. This concave leading edge is suitably dimensioned for providing effective mobilization of soft tissue of the upper or lower limbs of the human body. The convex rear edge of the instrument includes a convexly curved peripheral edge extending substantially from the upper edge to the lower edge of the instrument.

The upper handle portion of the instrument is defined by expanding upper portions of the sides of the instrument. These expanding upper portions lead to a generally rounded top surface and are preferably each provided with a non-slip surface.

In using this first embodiment, the concave leading edge of the instrument may be employed to engage and be moved along the skin of the patient to apply deep pressure to the underlying soft tissue. Alternatively, the rear edge or lower edge of the instrument may be utilized.

A second embodiment of a diagnostic and therapeutic instrument provided by this invention includes a hand-held rigid unitary body having a middle handle portion, an upper massaging portion, and a lower massaging portion opposite from the upper massaging portion. The upper massaging portion has a front surface, a rear surface, and a pair of curved lateral surfaces disposed opposite one another and extending between the front and rear surfaces. The front and rear surfaces converge and intersect one another at an uppermost point of the instrument to define a tissue-engaging blunt edge.

The lower massaging portion of this second instrument extends downwardly and outwardly from the middle handle portion such that it is offset laterally from the middle handle portion. The lower massaging portion terminates in an outwardly flared portion having a generally downwardly facing surface and a tissue-engaging curvilinear peripheral edge extending partially about the circumference of the downwardly facing surface. The downwardly facing surface and its peripheral edge are arranged in a common plane arranged at an acute included angle with respect to a longitudinal axis of the instrument. The downwardly facing surface is provided with a finger-receiving depression formed therein.

The middle handle portion has a generally tubular shape and a diameter tapering slightly from adjacent the lower massaging portion toward the upper massaging portion. The middle handle portion of the instrument body can also be provided with a non-slip surface to facilitate the firm grasping of the instrument.

In the use of this second embodiment, the upper blunt edge of the upper massaging portion of the instrument may be employed to engage and be moved along the skin of the patient to apply deep pressure to the underlying soft tissue. Alternatively, the curvilinear peripheral edge of the outwardly flared portion of the lower massaging portion of the instrument may be utilized. In this latter mode of use, the finger-receiving depression formed in the lower massaging portion is intended to receive the end or tip of a finger, e.g., thumb or index finger, of the practitioner or therapist, while the middle handle and upper massaging portions of the instrument are firmly held within the remaining fingers and palm. Such a grasp facilitates the practitioner's applying pressure when engaging and moving the instrument along the skin of a patient.

A third embodiment of a diagnostic and therapeutic instrument provided by this invention includes a hand-held rigid unitary body having an upper surface, a lower surface disposed opposite from the upper surface, and opposing lateral surfaces. The upper and lower surfaces converge at a first end to define a tissue-engaging blunt edge generally coinciding with the intersection of the upper and lower surfaces. The upper and lower surfaces diverge at an opposing second end to define a comparatively larger second end disposed opposite from the first end. The opposing lateral surfaces extend vertically between the upper and lower surfaces and longitudinally between the first and second ends of the instrument. The second end extends vertically between the upper and lower surfaces and horizontally between the opposing lateral surfaces.

The upper surface is defined by a gradually convexly curved surface extending at least partially and longitudinally along the length of the instrument body between the first and second ends thereof. The lower surface can be defined by a gradually concavely curved surface extending at least partially and longitudinally along the length of the instrument between the first and second ends thereof.

In use of this third embodiment, the tissue-engaging blunt end of the instrument may be employed to engage and be moved along the skin of the patient to apply deep pressure to the underlying soft tissue.

The rehabilitation and therapeutic benefits accomplished by the use of the instruments provided by this invention have exceeded most expectations. Beneficial results have been achieved an musculoskeletal conditions that had previously been considered difficult, if not impossible, to treat. The use of these instruments provide a highly effective, non-invasive, low-cost treatment for post traumatic fibrosis, tendinitis, repetitive stress injuries and cumulative trauma disorders, by causing micro-trauma to the fibrotic soft tissue that allows the human body's natural healing process to occur. Such soft tissue injuries may include both industrial and athletic injuries, such as Carpal tunnel syndrome, tennis elbow, post ACL reconstruction, and other extremity problems. These instruments break down the scar tissue around and within the affected area and prevent the formation of new scar tissue.

These instruments often help patients get between without the need for surgery and the associated medical expense and lost time from the workplace or recreational activities. In the current environment of healthcare cost containment and the "bundling" of pre- and post-operative care and treatment, the type of rehabilitation provided by the use of these instruments will prove to be extremely beneficial to the healthcare and insurance industries. Additional benefits include the need for surgery being reduced, patients no longer needing splints or braces or other modifications of their workplace environment, faster rehabilitation, recovery and normal functioning times for patients, and fewer visits with therapists being necessary than with traditional orthopedic and/or physical therapy treatments.

Other features and advantages of the invention will be apparent from the drawings and detailed description that follow.

BEST MODES FOR CARRYING OUT THE INVENTION

Figure 1:
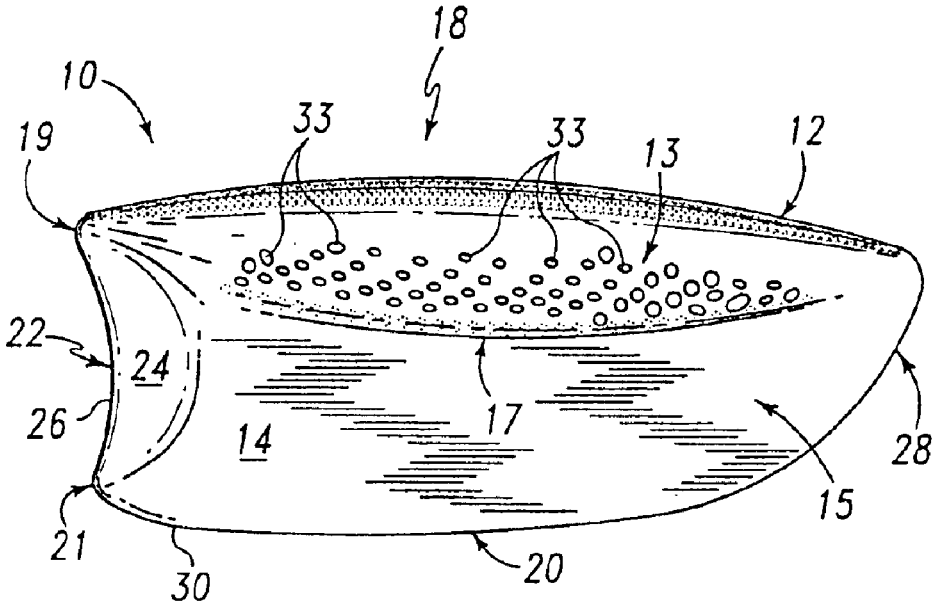
FIG. 1 is a side perspective view of a first preferred embodiment of a diagnostic and therapeutic instrument provided by this invention.
Figure 2:
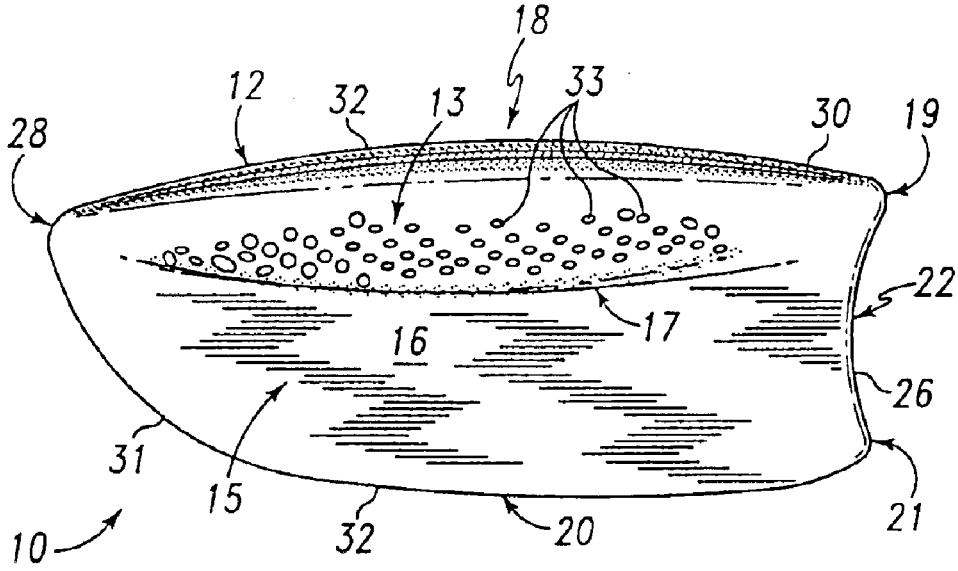
FIG. 2 is a side plan view of the opposing side of the instrument shown in FIG. 1.
Figure 3:
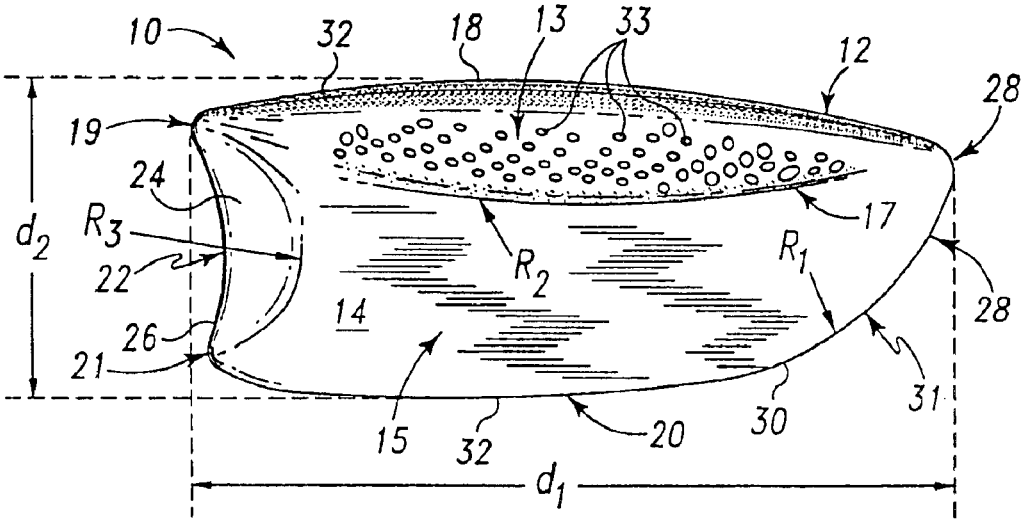
FIG. 3 is a second side plan view of the instrument shown in FIG. 1.

Referring to the drawings, wherein like reference numerals designate identical or corresponding parts and elements throughout the several views, this invention provides a first embodiment of an instrument 10 shown in FIGS. 1–10, a second embodiment of an instrument 40 shown in FIGS. 11–20, and a third embodiment of an instrument 80 shown in FIGS. 21–27, where each such instrument can be employed in the diagnosis of fibrotic soft tissue conditions and their treatment through soft tissue mobilization therapies.

Referring now to FIGS. 1–7, instrument 10 comprises a graspable unitary rigid body 12 comprising an upper handle portion 13, a lower massaging portion 15 formed by a pair of sides 14 and 16 converging from the upper handle portion 13, and a peripheral edge 30 extending about the circumference of the instrument body 12. The circumferential peripheral edge 30 can be defined by a curvilinear edge including a concave leading edge 22 and a convex rear edge 28 disposed opposite from the leading edge 22. Edge 22 intersects with an upper edge 18 and a lower edge 20 to define opposing rounded projections 19 and 21, respectively. The convex rear edge 28 includes a convexly curved peripheral edge extending from the upper edge 18 to the lower edge 20 of the instrument body 12. Lower edge 20 of the instrument can include a curved transition portion 31 and a substantially linear portion 32.

Instrument body 12 has a sufficient length to define a firmly graspable instrument that is longer that it is wide from upper edge 18 to lower edge 20. Body 12 is also longer than it is thick at upper handle portion 13.

The converging sides 14, 16 of the instrument taper in one direction to form an inclined chisel-like surface 24 at side 14 leading to the concave leading edge 22, which is defined by a concavely curved peripheral edge 26 extending from upper edge 18 of the instrument to its lower edge 20. The converging sides 14, 16 further taper toward one another from the upper handle portion 13 toward the lower edge 20 of the instrument to define the lower massaging portion 15. A junction 17 generally distinguishes the upper handle portion 13 from lower massaging portion 15 of the instrument.

Figure 4:
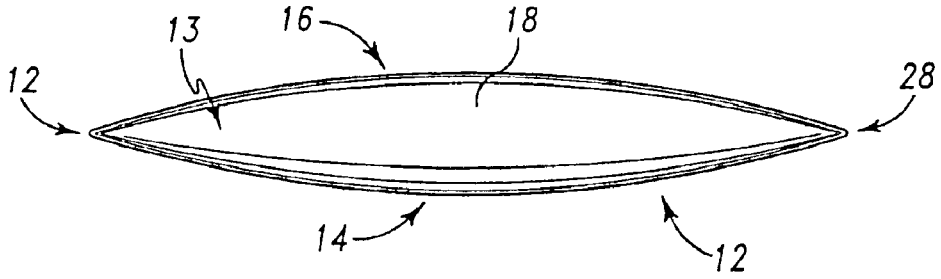
FIG. 4 is a top plan view of the instrument shown in FIG. 3.
Figure 5:
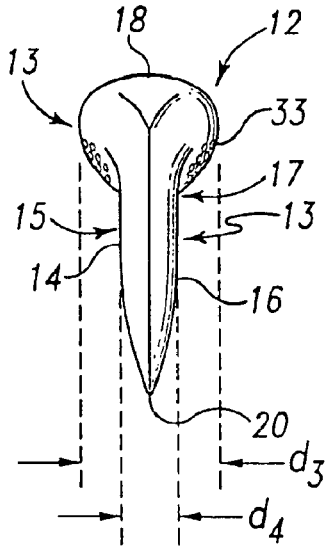
FIG. 5 is a plan view of the instrument shown in FIG. 3 as viewed from a right perspective.
Figure 6:
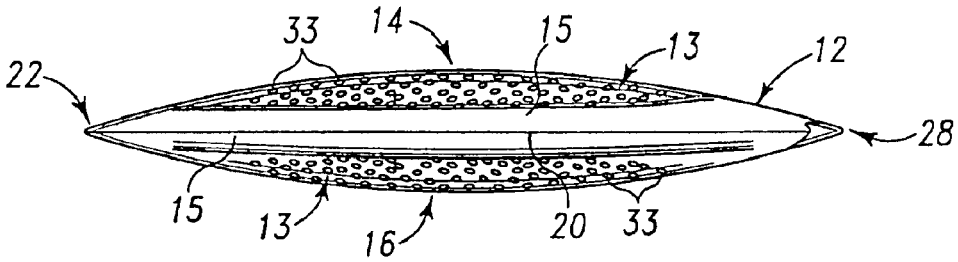
FIG. 6 is a bottom plan view of the instrument shown in FIG. 3.
Figure 7:
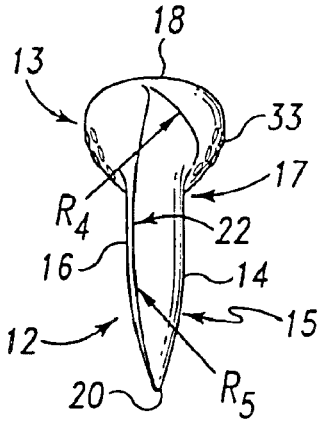
FIG. 7 is a plan view of the instrument shown in FIG. 3 as viewed from a left perspective.

Sides 14, 16 even further taper toward one another from a central portion of the instrument longitudinally in both directions toward each end of the instrument to define an equiconvex shape as shown best in FIGS. 4 and 6. Sides 14, 16 also expand at their upper portions to define upper handle portion 13, which includes a rounded upper edge 18 shown best in FIGS. 5 and 7.

To facilitate the grasping of the instrument 10, a non-slip surface may be provided along the upper and/or lower edges of the body 12 for receiving the fingers and palm of the practitioner in a contoured fashion. Such a non-slip surface may include grooves, ribs or undulations. In a preferred embodiment, a plurality of raised surface nubs 33 are provided on the upper handle portion 13 of the instrument body 12.

Figure 8:
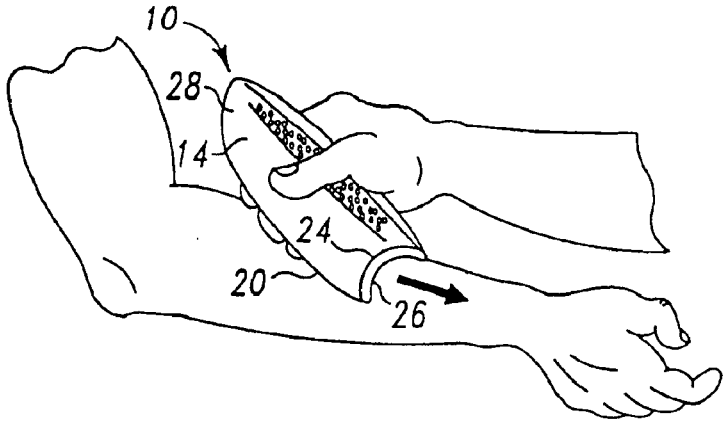
FIGS. 8–10 illustrate the variety of manners in which the instrument of FIGS. 1–7 may be employed to engage the skin of a patient to diagnose and treat underlying fibrotic soft tissue through soft tissue mobilization therapies.
Figure 9:
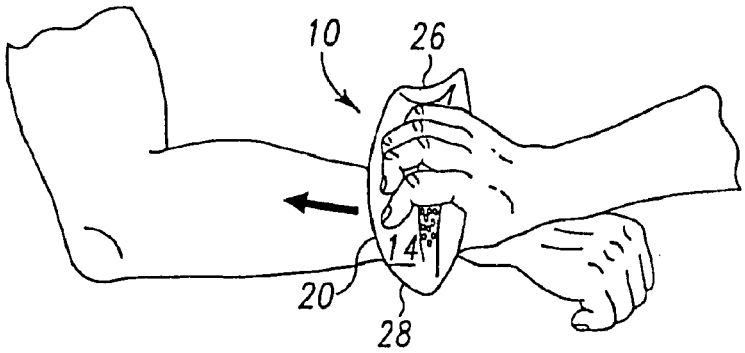
Figure 10:
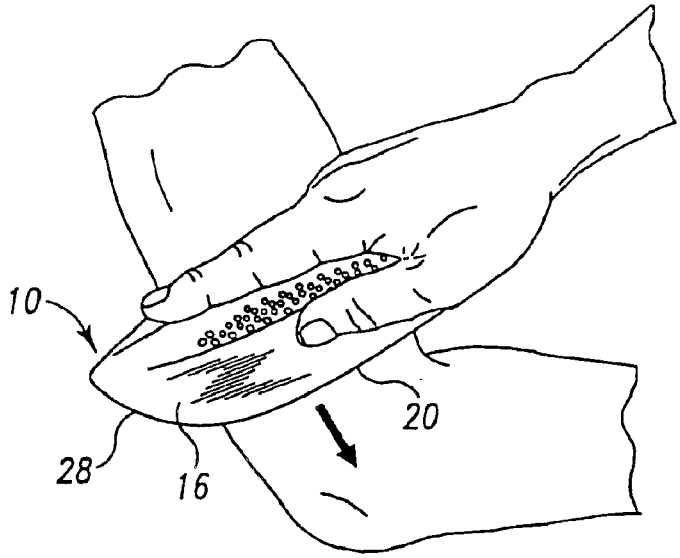
Figure 11:
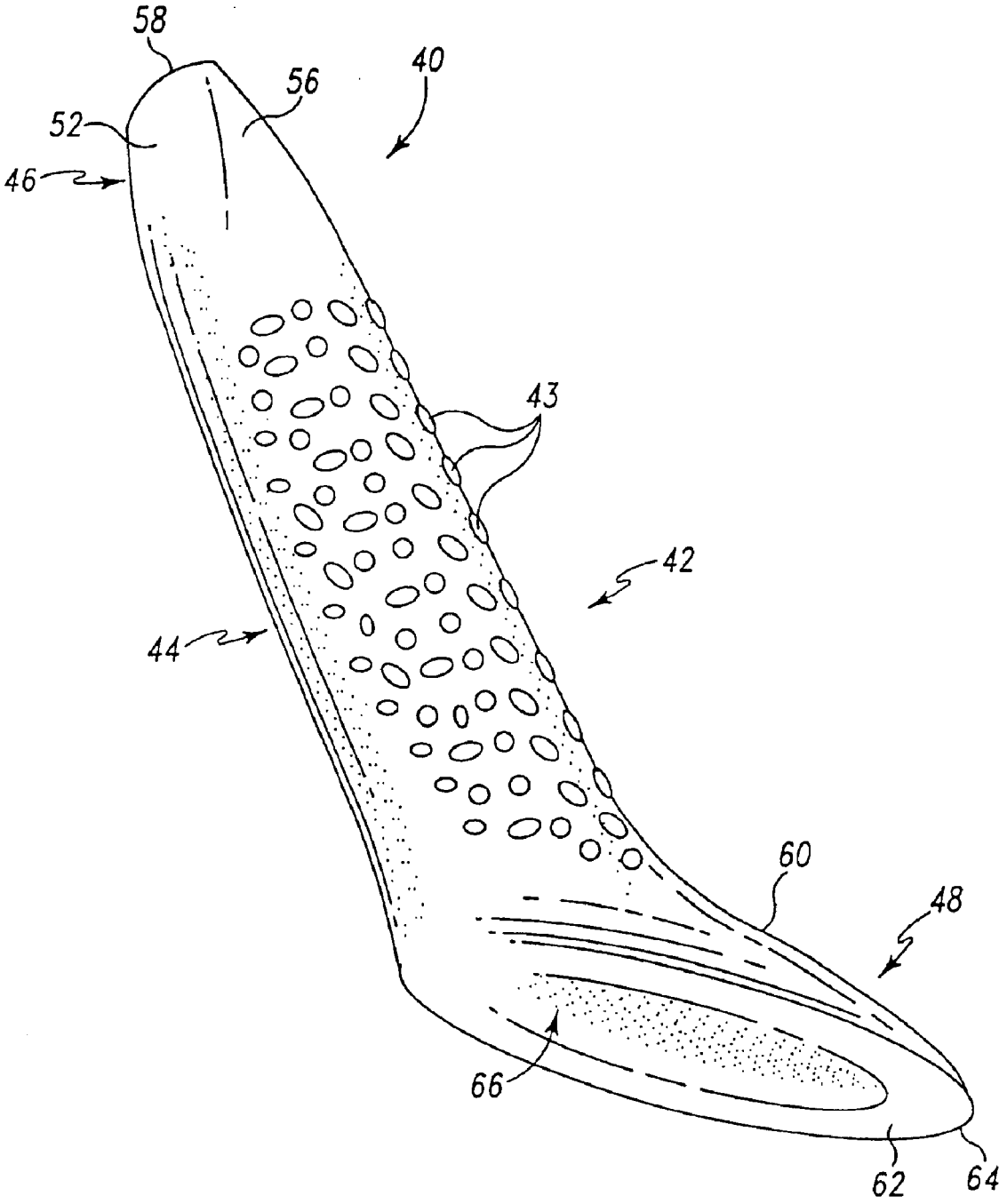
FIG. 11 is a perspective view of a second preferred embodiment of a diagnostic and therapeutic instrument provided by this invention.

In the use of instrument 10, the variety of curvilinear and linear configurations of the peripheral edge 30 and the tapered and converging surfaces of the instrument body 12 facilitate the use of instrument 10 on a variety of irregular contours of numerous soft tissue areas of the human body. For example, concave leading edge 26 and lower edge 20 are suitably dimensioned for providing effective mobilization of soft tissue of the upper or lower limbs of the human body, particularly in more fleshy areas such as in the belly of a muscle. As shown in FIG. 8, concave leading edge 26 may be employed to engage and be moved along the skin of the patient, particularly near or at the elbow, wrist, knee or ankle joints, in the direction of the reference arrow to apply deep pressure to the underlying soft tissue. Such use is most effective with the inclined surface 24 of side 14 facing away from the skin of the patient during use Alternatively, instrument 10 may be grasped in the manners shown in FIGS. 9 and 10 such that the lower edge 20 of the instrument 10 may be employed in the rendering of soft tissue mobilization therapies. While FIGS. 8–10 illustrate the employment of instrument 10 treating soft tissue areas of an upper extremity, practically any soft tissue area of the body can be treated with instrument 10.

A second preferred embodiment of a hand-held instrument 40 provided by this invention as shown in FIGS. 11–20 includes a graspable unitary rigid body 42 having a middle handle portions 44, an upper massaging portion 46, and a lower massaging portion 48 disposed opposite from the upper massaging portion. Middle handle portion 44 preferably has a generally tubular shape and a diameter slightly tapering from a point d5 (FIG. 14) adjacent the lower massaging portion 48 toward the upper massaging portion 46 such that the diameter of the middle handle portion gradually decreases from adjacent the lower portion toward the upper portion of instrument body 42.

Figure 15:
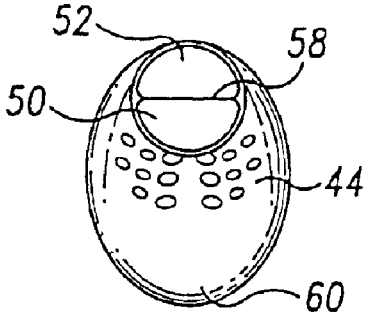
FIG. 15 is a top plan view of the instrument of FIG. 14.
Figure 16:
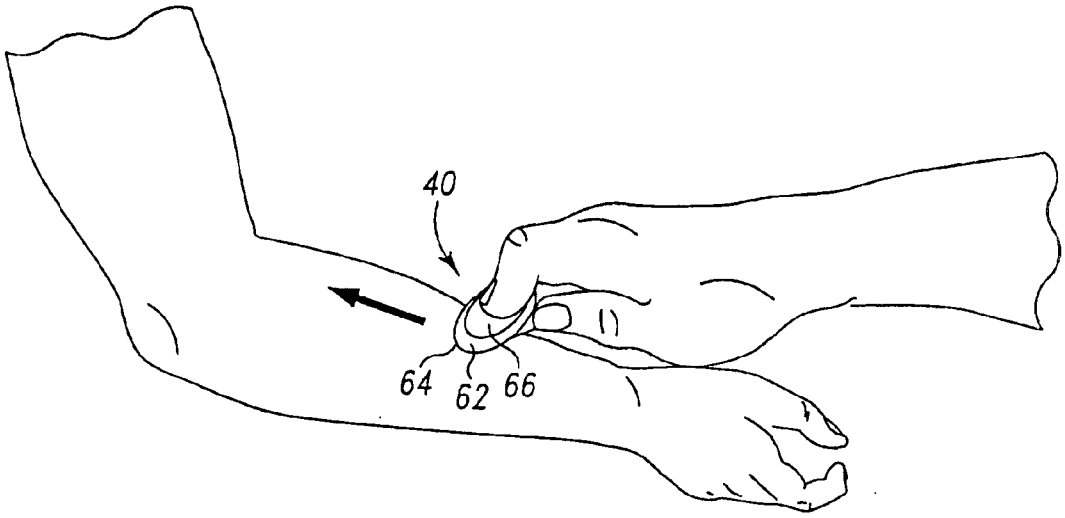
FIGS. 16–20 illustrate the variety of manners in which the instrument of FIGS. 11–15 may be employed to engage the skin of a patient to diagnose and treat underlying fibrotic soft tissue through soft tissue mobilization therapies.

Upper massaging portion 46 of instrument 40 preferably has a front surface 50, a rear surface 52 disposed opposite from the front surface 50, and a pair of curved lateral surfaces 54, 56 disposed opposite one another and extending between the front and rear surfaces 50, 52. Front and rear surfaces 50 and 52 are generally disposed in converging planes intersecting one another at an uppermost point of the instrument body 42 as best shown in FIGS. 12 and 15 to define an upper tissue-engaging blunt, substantially linear edge 58, which is disposed substantially transverse to a longitudinal axis of instrument body 42, thereby giving the upper massaging portion 46 of the instrument 40 a chisel-like shape.

Figure 12:
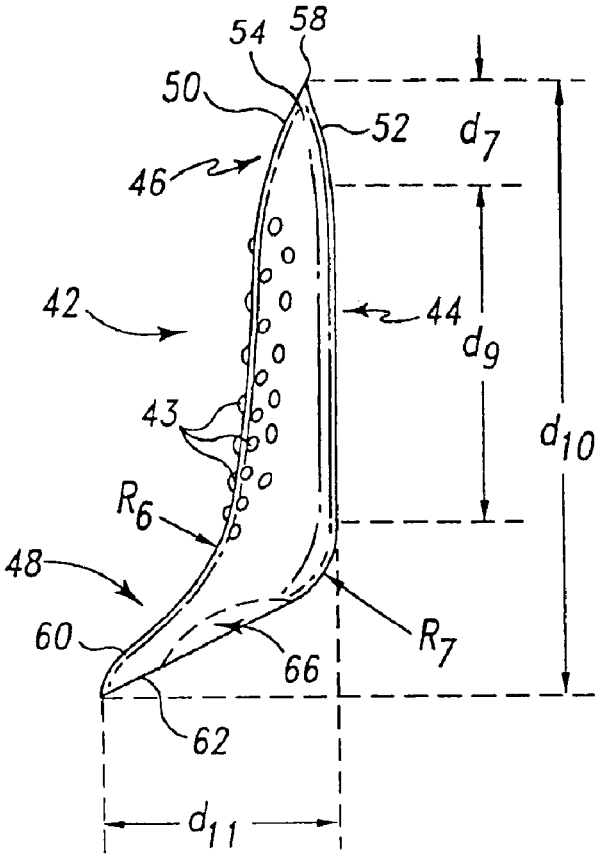
FIG. 12 is a side plan view of the instrument of FIG. 11.
Figure 13:
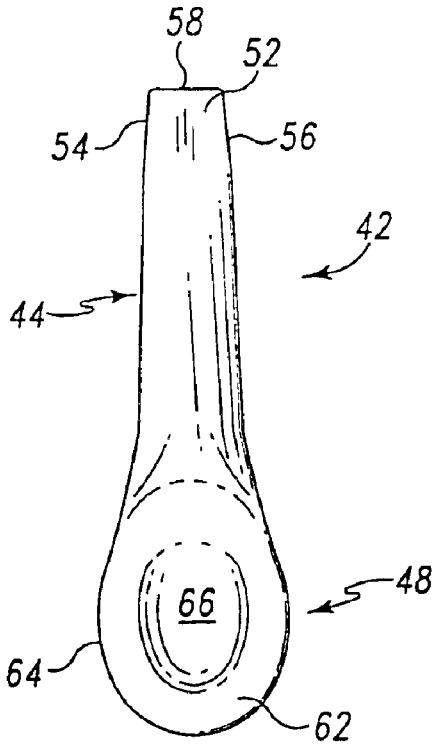
FIG. 13 is a rear plan view of the instrument of FIG. 11.
Figure 14:
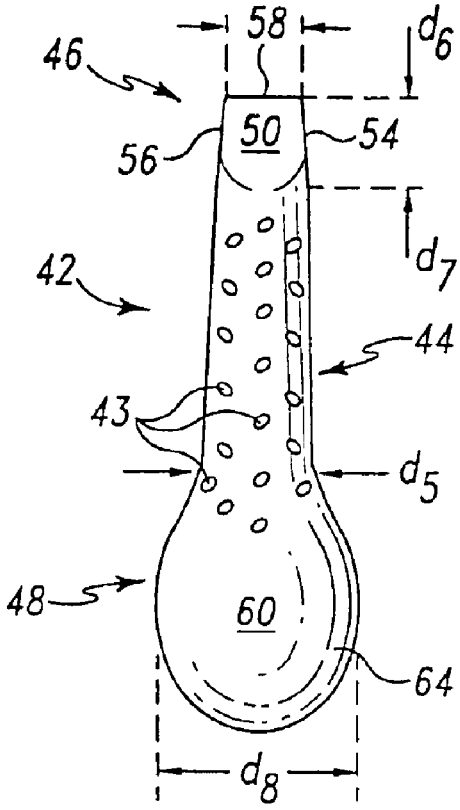
FIG. 14 is a front plan view of the instrument of FIG. 11.

Lower massaging portion 48 extends downwardly and outwardly, as shown best in the side plan view of FIG. 12, from middle handle portion 44 such that the lower massaging portion 48 is offset laterally therefrom. Lower massaging portion 48 terminates in an outwardly flared portion 60 having a generally downwardly facing surface 62 and a tissue-engaging curvilinear peripheral edge 64 extending partially about the circumference of surface 62. As shown in FIG. 12, the front surface 50 of upper portion 46 and the outwardly flared portion 60 of lower portion 48 are preferably oriented in the same general lateral direction. Peripheral edge 64 and downwardly facing surface 62 are preferably disposed in a common plane arranged at an acute included angle with respect to the longitudinal axis of instrument body 42. Downwardly facing surface 62 can further include a finger-receiving recess or depression 66 formed generally centrally of the surface 62.

To facilitate the grasping of the instrument 40, a non-slip surface may be provided about middle handle portion 44. In this second preferred embodiment, a plurality of raised surface nubs 43 can be provided about the middle handle portion 44 of the instrument body 12.

As with the instrument 10 described above, in the use of instrument 40, the variety of curvilinear and linear configurations of the tissue-engaging edges of the instrument body 42 facilitate its use on a variety of irregular contours of numerous soft tissue areas of the human body. In one such manner of use shown in FIG. 16, the instrument 40 may be firmly grasped such that the upper massaging portion 46 is snugly received within the palm of the hand with the fingers wrapping around the middle handle portion 44 and the index finger extending toward the lower massaging portion 48 of the instrument such that the tip of the practitioner's index finger is received within the recess 66. Such an arrangement provides increased leverage in pressing the instrument against the skin of the patient. In this mode of use, the curvilinear peripheral edge 64 of the lower massaging portion 48 of the instrument is utilized to engage and be moved along the skin in the direction of the reference arrow to apply pressure to mobilize the underlying soft tissue.

Figure 17:
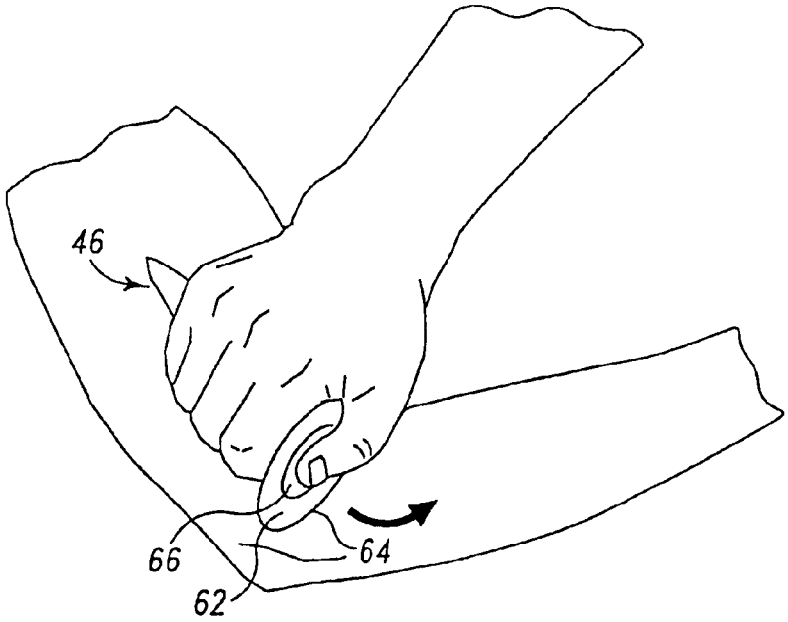
Figure 18:
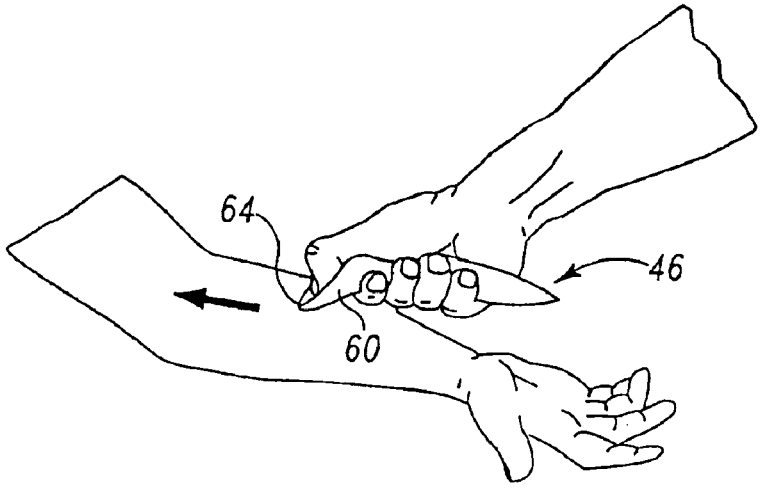

In a further mode of use of instrument 40 shown in FIG. 17, the practitioner may grasp the instrument such that his or her thumb is received within recess 66 provided in the lower massaging portion, while the middle and upper portions of the instrument body are firmly held within the remaining fingers and palm. Such an arrangement, akin to the manner in which one might grasp a "joy stick" employed in an amusement video game, facilitates applying pressure to the patient's skin when engaging the skin with curvilinear peripheral edge 64. In a slight modification, the same grip may be utilized to engage the skin with a different circumferential portion of edge 64 as shown in FIG. 18.

Figure 19:
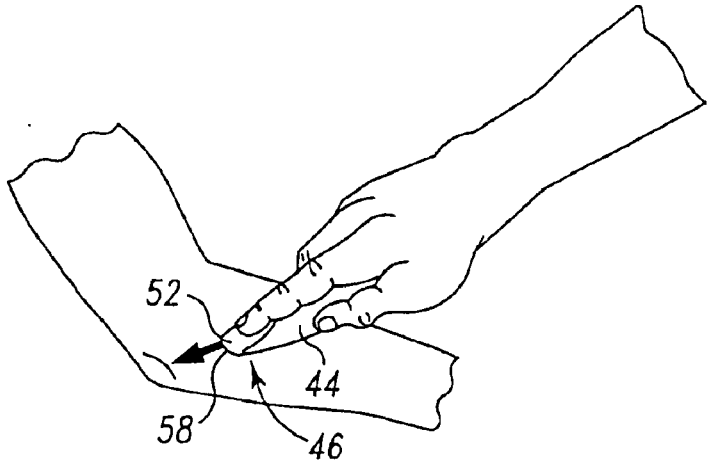
Figure 20:
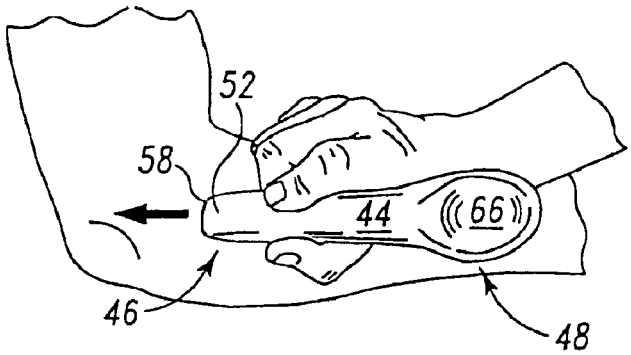
Figure 21:
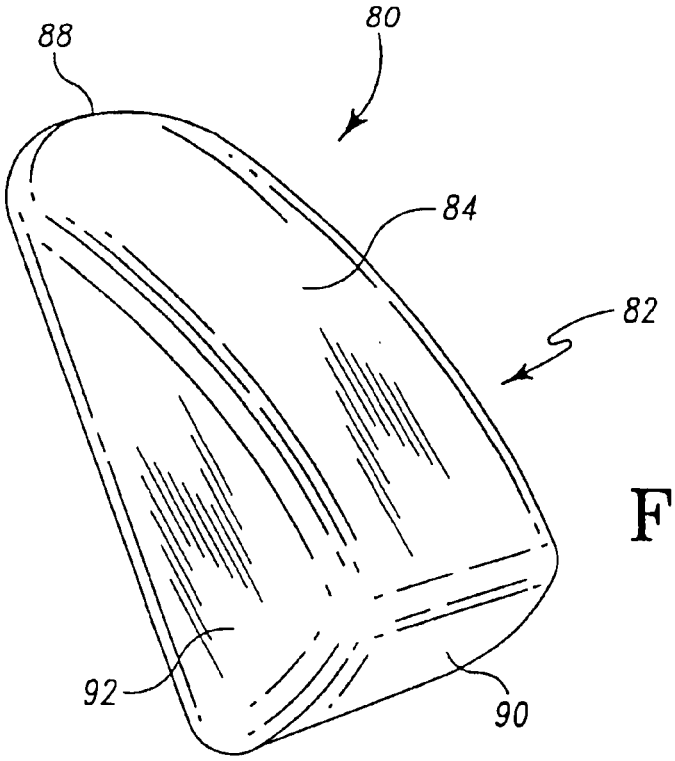
FIG. 21 is a perspective view of a third preferred embodiment of a diagnostic and therapeutic instrument provided by this invention.
Figure 22:
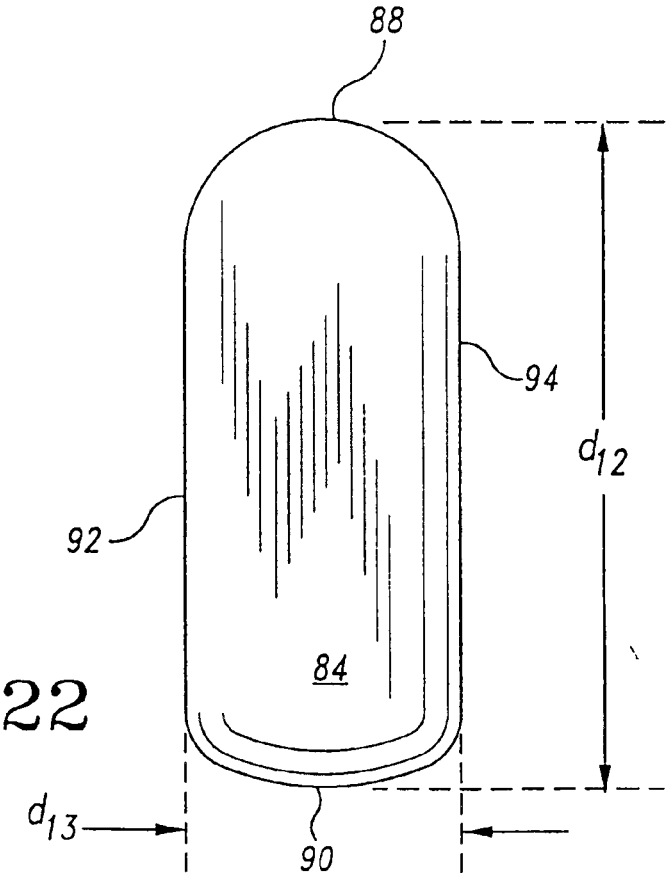
FIG. 22 is a top plan view of the instrument of FIG. 21.
Figure 23:
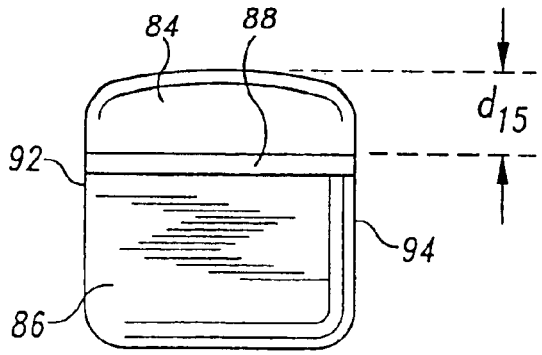
FIG. 23 is an end plan view as viewed from an upper direction of the instrument as depicted in FIG. 22.
Figure 24:
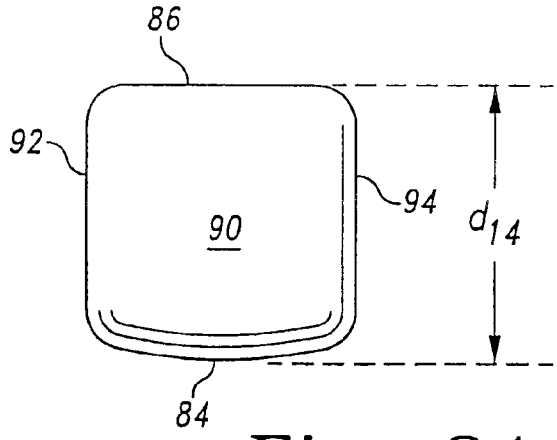
FIG. 24 is an end plan view as viewed from a lower direction of the instrument as depicted in FIG. 22.
Figure 25:
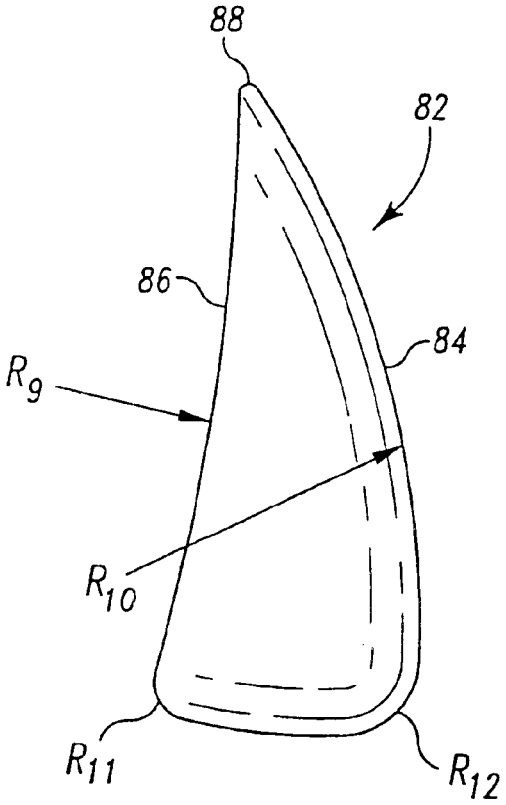
FIG. 25 is a side plan view of the instrument of FIG. 21.

As even further alternative modes of use, a practitioner may reverse his or her grasp of instrument 40 as shown in FIGS. 19 and 20 such that the uppermost blunt edge 58 of the upper massaging portion 46 of the instrument can be employed to engage and be moved along the skin of the patient in the direction of the reference arrows to apply pressure and mobilize the underlying soft tissue of generally smaller areas of the body, particularly those adjacent bony prominences. As shown in FIG. 19, instrument 40 may be firmly grasped such that an index finger of the practitioner is disposed along the middle handle and upper massaging portions of the instrument body with the tip of the index finger arranged adjacent to, and to bear against, the rear surface 52 of upper massaging portion 46 such that the tissue-engaging upper blunt edge 58 engages the patient's skin and tissue. In this mode of use, the middle handle and lower massaging portions of the instrument body are firmly held within the remaining fingers and palm of the practitioner.

In the further manner of use shown in FIG. 20, the practitioner can grasp the instrument 40 in a manner akin to holding a writing instrument such that the blunt edge 58 of the instrument engages the skin while the instrument is moved in the direction of the reference arrow. While instrument 40 has been illustrated in FIGS. 16–20 as treating soft tissue areas of an upper extremity, practically any soft tissue area of the body can be effectively treated with instrument 40.

A third preferred embodiment provided by this invention includes a hand-held instrument 80 shown in FIGS. 21–27 comprising a graspable unitary rigid body 82 having a first or upper surface 84, a second or lower surface 86 disposed opposite from surface 84, and opposing lateral surfaces 92, 94. The upper and lower surfaces 84 and 86 converge to define a tissue-engaging first end 88 defined by a blunt rounded edge generally coinciding with the intersection of surfaces 84 and 86. At an opposing second end of body 82, surfaces 84 and 86 are in a diverging relation to one another to define a comparatively larger second end 90 extending between the upper and lower surfaces 84, 86 and opposing lateral surfaces 92, 94.

The upper surface 84 of instrument 80 is preferably defined by a gradually yet continuously convexly curved surface extending along the length of the instrument body between blunt end 88 and second end 90. In a transverse direction, upper surface 84 is preferably slightly crowned as shown best in FIG. 23 to enhance its ergonomic fit within the hand of a practitioner. Lower surface 86 is similarly preferably defined by a gradually yet continuously concavely curved surface extending along the length of instrument body 82 between blunt end 88 and second end 90. In a transverse direction, lower surface 86 is preferably substantially planar.

Figure 26:
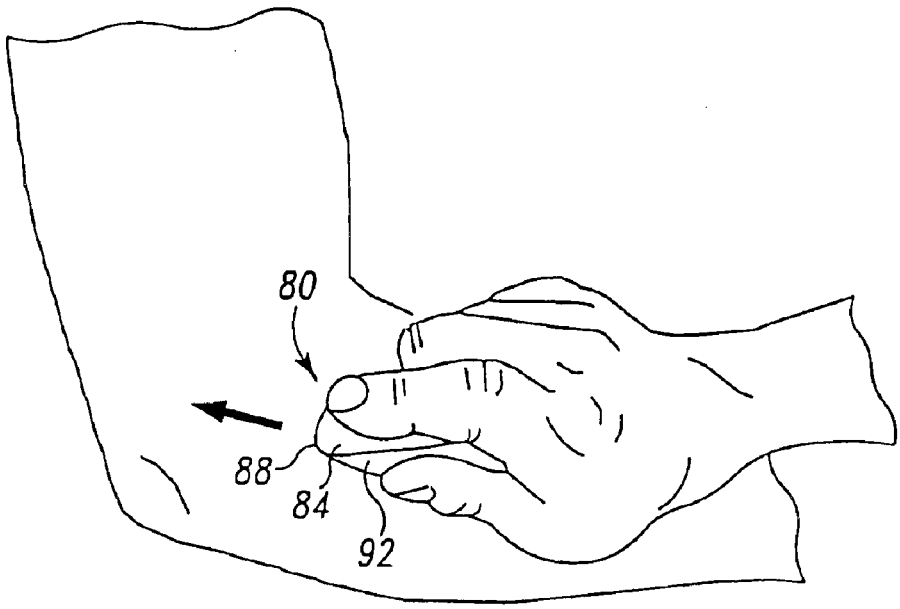
FIGS. 26 and 27 illustrate the variety of manners in which the instrument of FIGS. 21–25 may be employed to engage the skin of a patient of diagnose and treat underlying fibrotic soft tissue through soft tissue mobilization therapies.
Figure 27:
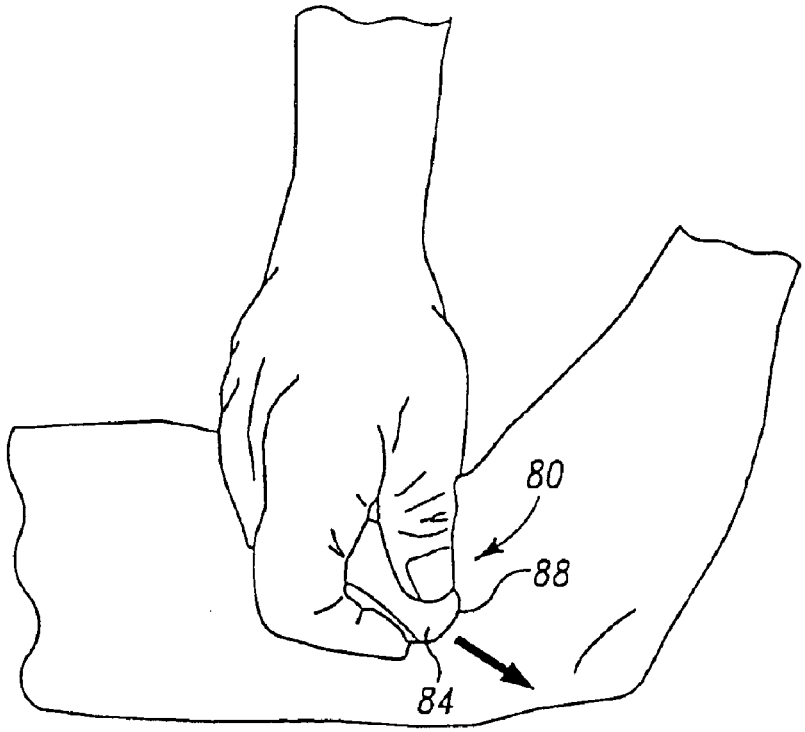

In the employment of instrument 80 in the performance of soft tissue mobilization as shown in FIGS. 26 and 27, the tissue-engaging blunt end 88 of instrument 80 is intended to engage and be moved along the skin of the patient in the direction of the reference arrows to apply pressure and mobilize the underlying soft tissue. Instrument 80 is particularly suitable in treating soft tissue areas involved in controlled fine movements, such as about the wrist, the back of the hand, the fingers, and the like. Instrument 80 is most effective when used with upper surface 84 facing away from the patient's skin as shown in FIGS. 26 and 27.

The bodies 12, 32 and 82 of the instruments 10, 30 and 80 provided by this invention and described above can be fabricated from a variety of materials. Preferably, however, such tools are fabricated from a resonant material such that the fibrotic soft tissues, which can be distinctly felt through the overlaying soft tissue, may induce a force wave through the instrument when engaged by one of the tissue-engaging edges of the instruments. Such resonance may then be felt by a trained practitioner through his or her hand which holds the instrument. Such a material also feels "very real" to the patient allowing him or her to feel the changes in the soft tissue texture as treatments progress. A suitable material having these characteristics from which these instruments may be fabricated is a resin ceramic composite available from Scott Art Castings, Inc., Indianapolis, Ind., under the product designation "DS 1100". Conventional casting methods suitable for such material can be employed to construct the three-dimensional design of the instruments.

In the fabrication of the therapeutic and diagnostic instruments provided by this invention, the following dimensions referred to in the Figures and listed in Table One below are preferred:

TABLE ONE

| | Value (inches) |
|---|---|
| Dimension | |
| d1 | 6.3125 |
| d2 | 2.8125 |
| d3 | 1.0000 |
| d4 | 0.5000 |
| d5 | 1.2000 |
| d6 | 0.7500 |
| d7 | 1.0000 |
| d8 | 1.7500 |
| d9 | 3.2500 |
| d10 | 5.7500 |
| d11 | 2.2500 |
| d12 | 2.2500 |
| d13 | 0.8750 |
| d14 | 0.8750 |
| d15 | 0.2500 |
| Radius | |
| R1 | 3.0000 |
| R2 | 20.2500 |
| R3 | 1.0500 |
| R4 | 0.6250 |
| R5 | 5.5000 |
| R6 | 2.0000 |

TABLE ONE-continued

| | Value (inches) |
|---|---|
| R7 | 1.0000 |
| R8 | 0.5000 |
| R9 | 7.0000 |
| R10 | 3.2500 |
| R11 | 0.1250 |
| R12 | 0.2500 |

In the use of the instruments of this invention to diagnose fibrotic soft tissue conditions, the larger instrument 10 is preferably initially employed to identify and evaluate the extent of fibrotic soft tissue in larger surface areas of the body. The lower edge 20 of the instrument is particularly useful in treating muscle bellies between the origin and insertion of a muscle. The leading edge 26 may be used with smaller yet still open tissue areas, such as those areas between the joints of the upper and lower extremities. As shown and discussed above in relation to the figures, instruments 40 and 80 may be used in a progressive fashion to treat smaller or finer tissue areas, particularly as the soft tissue condition improves as treatments progress. As noted above, the instruments of this invention provide a mechanical stimulus that triggers the normal healing process of the body by inducing micro-trauma at the cellular level of the soft tissue to create localized inflammation. Then normal healing process then takes over, involving the resorption of inappropriate tissues and the remodeling or realignment of soft tissue structures.

Although the instruments provided by the present invention have been described with preferred embodiments, those skilled in the art will understood that modifications and variations may be made without departing from the scope of this invention as set forth in the following claims. Such modifications and variations are considered to be within the purview and scope of the appended claims.

What is claimed is:

1. A diagnostic and therapeutic instrument, comprising:

a body having a first upper surface, a second lower surface disposed opposite from said upper surface, and opposing lateral surfaces, said upper and lower surfaces converging at a first end to define a blunt tissue-engaging edge and diverging at an opposing second end to define a comparatively larger second end defined by a surface extending between said upper and lower surfaces, said opposing lateral surfaces extending vertically between said upper and lower surfaces and longitudinally between said first and second ends of said instrument body; wherein said instrument body is constructed of a resin ceramic composite material having resonant capabilities such that said body aids in diagnosis and treatment of fibrotic soft tissue.

2. The instrument as in claim 1 wherein said upper surface is defined by a continuously curved surface extending at least partially along the length of said instrument body between said first and second ends thereof.

3. The instrument as in claim 1 wherein said lower surface is defined by a continuously curved surface extending at least partially along the length of said instrument body between said and second ends thereof.

4. A hand-held instrument for engaging and applying pressure to the skin of patient in the diagnosis or treatment of underlying fibrotic soft tissue, comprising:

a rigid unitary body having an upper surface, a lower surface disposed opposite from said upper surface, said upper and lower surfaces converging at a first end to define a blunt tissue- engaging edge generally coinciding with the intersection of said upper and lower surfaces and diverging at an opposing second end to define a comparatively larger second end disposed opposite from said first end, and opposing lateral surfaces extending vertically between said upper and lower surfaces and longitudinally between said first and second ends of said instrument body, said upper surface being defined by a gradually convexly curved surface extending at least partially and longitudinally along the length of said instrument body between said first and second ends thereof, said lower surface being defined by a gradually yet continuously concavely curved surface extending substantially and longitudinally along the entire length of said instrument body between said first and second ends thereof; and wherein said lower surface is substantially planar in a transverse direction to the length of said instrument body.

5. The hand-held instrument as in claim 4 wherein the upper surface is slightly crowned along a direction transverse to the length of said instrument body.

6. The hand-held instrument as in claim 4 wherein, in the use of said instrument, the blunt end of the first end of said instrument body engages the skin of the patient.

7. The hand-held instrument as in claim 4 wherein said instrument body is constructed of a resin material having resonant capabilities.

8. The hand-held instrument as in claim 4 wherein said upper surface extends substantially and longitudinally along the length of said instrument body between said first and second ends thereof.

9. The hand-held instrument as in claim 4 wherein said opposing lateral surfaces are substantially parallel.

10. The hand-held instrument as in claim 4 wherein the ratio of the length ($d_{12}$) and the width ($d_{13}$) is at least 2.4 to 1.

11. The hand-held instrument as in claim 4 wherein the ratio of the height ($d_{14}$) to the width ($d_{13}$) is approximately 1 to 1.

12. The hand-held instrument as in claim 4 wherein said upper surface is slightly crowned along a transverse direction between said opposing lateral surfaces.

* * * * *